US009670681B2

(12) United States Patent
Buzon

(10) Patent No.: US 9,670,681 B2
(45) Date of Patent: Jun. 6, 2017

(54) ANCHORING MEMBER

(71) Applicant: Buzon Pedestal International, Herstal (BE)

(72) Inventor: Claude Buzon, Herstal (BE)

(73) Assignee: BUZON PEDESTAL INTERNATIONAL, Herstal (BE)

( * ) Notice: Subject to any disclaimer, the term of this patent is extended or adjusted under 35 U.S.C. 154(b) by 0 days.

(21) Appl. No.: 15/086,254

(22) Filed: Mar. 31, 2016

(65) Prior Publication Data

US 2016/0298339 A1 Oct. 13, 2016

(30) Foreign Application Priority Data

Apr. 10, 2015 (BE) ..... 2015/0125

(51) Int. Cl.
*A47B 96/06* (2006.01)
*E04F 15/024* (2006.01)

(52) U.S. Cl.
CPC ..... *E04F 15/02452* (2013.01)

(58) Field of Classification Search
USPC ..... 248/219.2
See application file for complete search history.

(56) References Cited

U.S. PATENT DOCUMENTS 3,318,057 A * 5/1967 Norsworthy ..... E04F 15/02452 52/126.6
4,074,488 A * 2/1978 Ray, III ..... E04F 15/02405 52/126.6
4,277,923 A * 7/1981 Rebentisch ..... E04F 15/02458 52/126.6
4,685,258 A * 8/1987 Av-Zuk ..... E04F 15/02452 52/126.6
4,736,555 A * 4/1988 Nagare ..... E04F 15/02452 248/544
4,835,924 A * 6/1989 Blacklin ..... E04F 15/02452 52/263
4,901,490 A * 2/1990 Zinniel ..... E04F 15/02405 248/346.5
4,996,804 A * 3/1991 Naka ..... E04F 15/02482 52/126.1
5,333,423 A * 8/1994 Propst ..... E04F 15/02476 248/188
5,389,737 A * 2/1995 Kobayashi ..... E04F 15/02435 174/483
6,604,330 B2 * 8/2003 Repasky ..... E04D 11/005 411/395

(Continued)

FOREIGN PATENT DOCUMENTS

DE 10100399 7/2002
DE 102011101567 11/2012

*Primary Examiner* — Monica Millner
(74) *Attorney, Agent, or Firm* — Jacobson Holman PLLC

(57) ABSTRACT

Anchoring member provided for being mounted on a support pedestal, which anchoring member comprises a plate provided with a notch extending as from a part of his border, which plate is provided for being partially entered in each time a cut-out situated in a lateral sidewall of a corner of a tile resting on the support pedestal, wherein the plate comprises a geometry essentially parallelogram shaped, said notch extending from a first corner located on a crossing of a first raising edge and a first horizontal edge of the parallelogram shaped geometry over essentially a quarter of the plate surface.

10 Claims, 3 Drawing Sheets

(56) References Cited

U.S. PATENT DOCUMENTS

| | | | | |
|---|---|---|---|---|
| 8,302,356 | B2 | 11/2012 | Knight, III et al. | |
| 8,690,109 | B2 * | 4/2014 | Haworth | F16B 43/009 248/218.4 |
| 8,820,011 | B1 * | 9/2014 | Parks | E04F 15/02183 52/126.6 |
| 8,898,999 | B1 * | 12/2014 | Kugler | E04F 15/02464 52/126.6 |
| 2002/0026757 | A1 * | 3/2002 | Scissom | E04F 15/02452 52/220.2 |
| 2003/0089049 | A1 * | 5/2003 | Scissom | E04F 15/02452 52/126.1 |
| 2004/0065028 | A1 * | 4/2004 | Wu | E04F 15/02452 52/196 |
| 2004/0261329 | A1 * | 12/2004 | Kugler | E04F 15/02183 52/126.6 |
| 2005/0005547 | A1 * | 1/2005 | Mead | E04F 15/02476 52/263 |
| 2007/0204539 | A1 * | 9/2007 | Owen | E04F 15/0247 52/263 |
| 2008/0141601 | A1 * | 6/2008 | Mead | E04F 15/02452 52/263 |
| 2010/0205874 | A1 * | 8/2010 | Zlatar | E04F 15/02452 52/126.6 |
| 2011/0016809 | A1 | 1/2011 | Knight, III et al. | |
| 2012/0073218 | A1 * | 3/2012 | Zlatar | E04F 15/02452 52/126.6 |
| 2013/0047529 | A1 * | 2/2013 | Foden | B32B 15/10 52/220.1 |

* cited by examiner

ANCHORING MEMBER

The present invention relates to an anchoring member provided for being mounted on a support pedestal, which anchoring member comprises a plate provided with a notch extending as from a part of a border of said plate, which plate is provided for being partially entered in each time a cut-out situated in a lateral sidewall of a corner of a tile resting on the support pedestal.

Such an anchoring member is known from the U.S. Pat. No. 8,302,356. For building purpose use, is made of support pedestals either to compensate the inclination of a slope, or for raising up the level of the ground. On those support pedestals tiles can rest by placing for example the corners of four adjacent tiles each time on a support pedestal. The anchoring member serves for wedging the tiles on the pedestal and to thus considerably limiting a movement of the tiles with respect to the support pedestal. The known anchoring member has an essentially circular shape with a notch, which serves for facilitating the placing of the tiles and the anchoring member. The anchoring member is fixed on the support pedestal with the help of a screw, which is screwed through the centre of the anchoring member.

A drawback of the known anchoring member is his circular shape. Indeed, if on the one hand the circular shape facilitates the rotation of the anchoring member in the cut-out of the tiles, it limits however the surface over which the anchoring member can grip into the cut-out of each of the tiles of which the corner rests on the support pedestal. On the other hand the symmetrical form, which is inherent to the circle, does not allow to verify if the anchoring member is correctly placed in each cut-out in order to enable a correct grip of the anchoring member in each cut-out.

The object of the invention is to realise an anchoring member which enables on the one hand to better verify that it is correctly placed in each cut-out and on the other hand to enable a more firm grip of the anchoring member in each cut-out.

To this purpose an anchoring member according to the present invention is characterised in that the plate comprises a geometry essentially parallelogram shaped, said notch extending from a first corner located on a crossing of a first raising edge and a first horizontal edge of the parallelogram shaped geometry over essentially a quarter of the plate surface. The parallelogram shape enables to have more plate surface which engages into the cut-out and thus a better grip of the anchoring member in the cut-out of each of the tiles of which the corner rests on the support pedestal. Moreover, the fact that surface has raising and horizontal edges implies that within the space between two adjacent tiles it will be possible to see if the edge extends therein or not, and thus to correctly place the anchoring member in order to insure a correct grip in each cut-out.

A first preferred embodiment of an anchoring member according to the invention is characterised in that a second horizontal edge of the parallelogram shaped geometry is provided with a cavity. The presence of the cavity enables to align this cavity with the space between two adjacent tiles and thus to facilitate the correct placing of the anchoring member.

A second preferred embodiment of an anchoring member according to the invention is characterised in that the cavity extends over a depth of about 3 mm. Thus the cavity is sufficiently visible without therefor weakening the anchoring member.

A third preferred embodiment of an anchoring member according to the invention is characterised in that the parallelogram shaped geometry comprises a second and a third corner respectively situated at the other end of the first raising edge and the first horizontal edge of the one where the first corner is situated, said second and third corner being rubbed. The fact that these two corners are rubbed enables to increase the length of the edges and thus the grip of the plate in the cut-outs without adversely affecting the rotation or requiring deep cut-outs in the tiles.

A fourth preferred embodiment of an anchoring member according to the invention is characterised in that at a fourth corner of the parallelogram shaped geometry situated diagonally opposite to the first corner is provided with a hole crossing the plate. This hole enables to introduce therein a screw which will serve for maintaining the anchoring member in place on the support pedestal.

Preferably a lower surface of the plate is provided with water draining grooves. This prevents water to remain in place under the plate, as the grooves enable to evacuate that water.

Preferably a stem extends from a lower surface of the plate, which stem is provided with a threaded section. This facilitates the placing of the anchoring member on the support pedestal.

The invention will now be described in more details with respect to the drawings which illustrate an embodiment of an anchoring member according to the invention. In the drawings.

Figure 1:
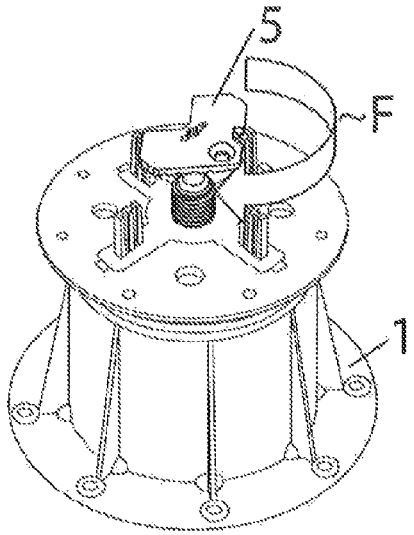
FIG. 1 illustrates the placing of an anchoring member on the support pedestal.

In the drawings a same reference sign has been allotted to a same or analogous element.

Figure 2:
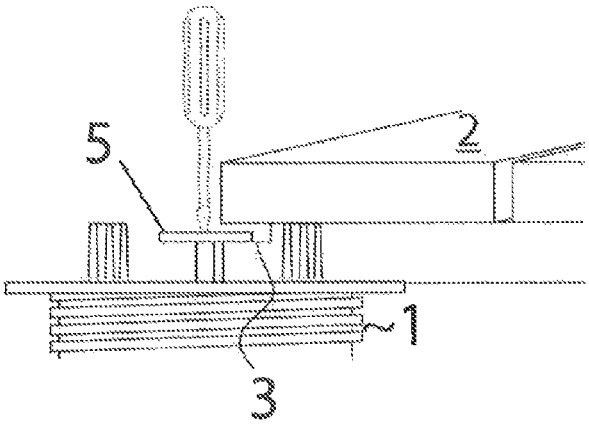
FIG. 2 shows the insertion of the anchoring member in a cut-out of a tile.
Figure 3:
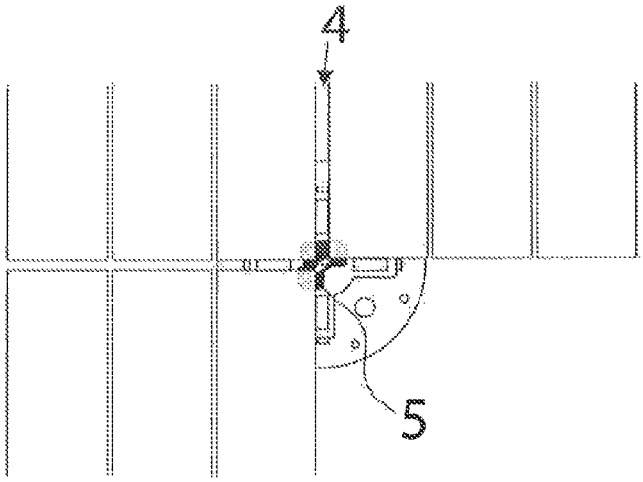
FIG. 3 shows a support pedestal on which three corners of three tiles are placed.

FIG. 1 shows a support pedestal 1 on which an anchoring for member 5 is placed. The anchoring member is provided for being mounted on the support pedestal 1, in particular at the centre of the upper surface of the support pedestal. The support pedestal serves either to compensate the inclination of a slope, or to raise the level of the ground. Preferably the anchoring member is screwed on the support pedestal, as indicated by the arrow F. FIG. 2 shows the insertion of a part of the anchoring member 5 in a cut-out 3 of a tile 2. The cut-out is located on a section of two edges which join at the corner of the tile. The tile comprises on each of its corners a cut-out. The tile is placed on the support pedestal in such a manner that a corner of the tiles rests on substantially a quarter of the upper surface of the support pedestal, as illustrated in FIG. 3. In such a manner when the corners of the tiles are each time placed on the support pedestal, the cut-outs face each other. Between two adjacent tiles a space 4 is foreseen, for example for enabling rain water to flow away between two adjacent tiles. The cut-outs preferably have depth situated between 3 and 6 mm, a height of approximately 5 m and a width situated between 10 and 15 mm.

Figure 4:
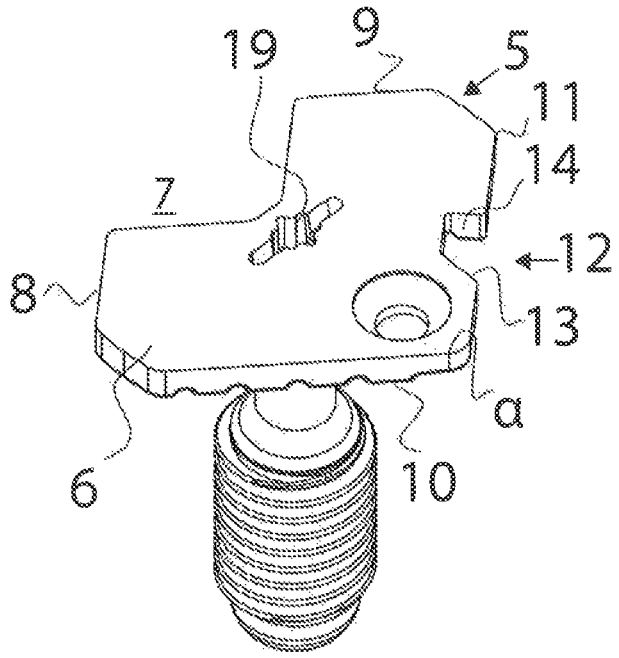
FIG. 4 shows a view of an anchoring member according to the invention.

FIG. 4 shows a view of the anchoring member 5 according to the invention. The anchoring member comprises a plate 6 provided with a notch 7 which extends from a part of his border. The plate is provided for being introduced partly in each time the cut-out 3 situated on the lateral edge of a corner of the tiles 2 resting on the support pedestal and thus maintain the tiles in place on the support pedestal. Preferably the plate has a thickness of approximately 4 mm.

Figure 5:
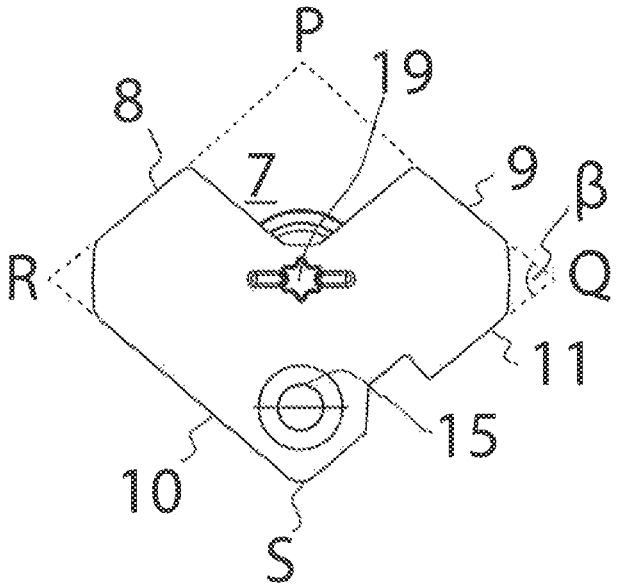
FIG. 5 shows the essentially parallelogram shaped geometry of an anchoring member according to the invention.

The plate 6 has a geometry essentially parallelogram shaped, as illustrated in FIG. 5. The plate has a first raising edge 8 and a first horizontal edge 9 of the parallelogram shape. The plate also has a second raising edge 11 and a second horizontal edge 10 of the parallelogram shape. The horizontal edges 9 and 10, as well as the raising edges 8 and 11 are each time parallel to each other. The angle $\alpha$ between the second raising edge 11 and the second horizontal edge 10 is preferably of about 100°, while the angle $\beta$ between the second raising edge 11 and the first horizontal edge 9 is preferably about 80°.

The notch 7 extends from a first corner P located on a crossing of the first raising edge 8 and the first horizontal edge 9 of the parallelogram shape. The notch 7 extends over essentially a quarter of the surface of the plate and reduces as if to say with half the length of the first raising edge 8 and the first horizontal edge 9.

Preferably the second raising edge 11 of the parallelogram shape is provided with a cavity 12. The latter extends from the centre of the second raising edge 11 in the direction of the first raising edge 8. The cavity preferably has an entering edge 14 with a right angle and another entering edge 13 with an angle inclined over about 20°. The cavity extends over a depth of about 3 mm. This cavity serves to correctly position the anchoring member during the mounting, as will be described hereunder.

The plate 6 having a parallelogram shape comprises a second and a third R corner situated respectively at the other end of the first raising edge 8 and the first horizontal edge 9 of the one where the first corner P is located. These second and third corners are rubbed for enabling the rotation of the plate in the cut-outs, as will be described hereunder. A fourth corner S of the parallelogram shape situated diagonally opposed to the first corner P is provided with a hole 15 crossing the plate. This hole serves to introduce therein a screw for fixing the anchoring member on the support pedestal.

Figure 6:
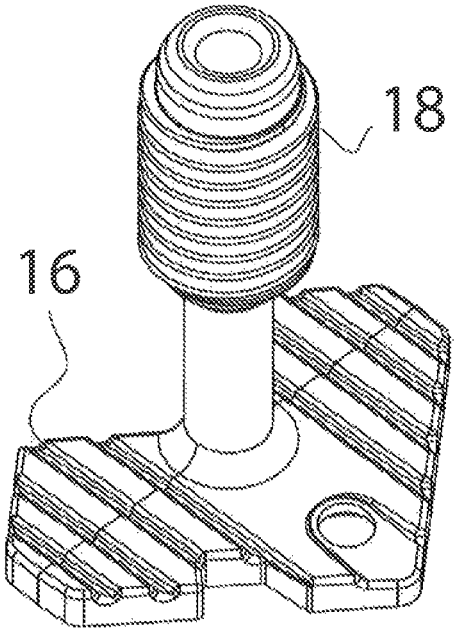
FIG. 6 shows a view of the under part of an anchoring member according to the invention.
Figure 7:
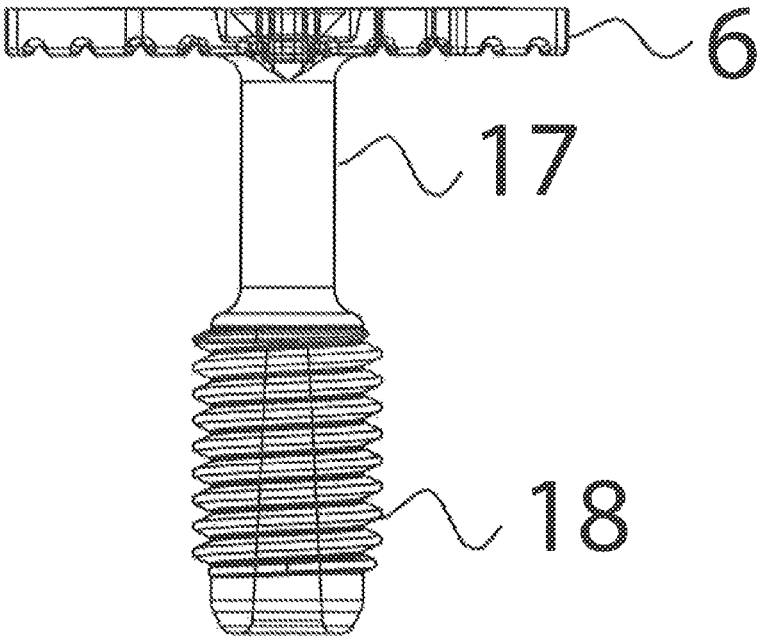
FIG. 7 shows a cross-section through an anchoring member according to the invention.

Preferably the lower surface of the plate 6 is provided with water draining grooves 16, as illustrated in FIG. 6. This prevents water to remain under the plate as those draining grooves enable the water to leave. The plate preferably comprises a stem 17, which extends from the lower surface of the plate. The stem is provided with a threaded section 18, which preferably protrudes on the stem and enables to screw the anchoring member on the support pedestal. The threaded section extends over approximately half of the height of the stem on the lower part of this stem in such a manner as not to disturb the tiles placed on the support pedestal.

Preferably the upper surface of the plate is provided with further cavity 19 provided for receiving the head of a screwdriver for thus screwing the anchoring member on the support pedestal. The further cavity is located in the extension of the stem 17.

For mounting the anchoring member on the support pedestal one first screws the anchoring member by using its threaded section on the support pedestal, thereby using for example a screwdriver. Thereafter the position of the anchoring member is adjusted such that the notch is at the place where the corner of the tile has to be placed. The anchoring member is then shifted in the cut-out 3 of the tile 2 by rotating the anchoring member and the height is adjusted so that the anchoring is correctly placed in the cut-out. The anchoring member is rotated in such a manner that the notch of the anchoring member situated at the place where the corner of the next tile must be placed, thereby enabling a placing of the next tile without the anchoring member hindering this placing. The operation is repeated for the other tiles to be placed with their corner on the support pedestal. After having placed the four tiles on the support pedestal, the anchoring member is rotated in such a manner that the notch is hidden in a cut-out of one of the tiles. The anchoring member is rotated such that only the edges are still visible in the space between the tiles and the hole 15 is also visible in a space between two tiles. In such a manner care is taken that in each cut-out there is sufficient material of the anchoring member so as to correctly retaining the corners of the tiles on the support pedestal. The fact that the surface has a parallelogram shape takes care that there is enough material as the edges of the parallelogram enable to engage more material in the cut-out. The presence of two rubbed corners takes care that the rotation of the plate in the cut-outs of the tiles is not disturbed.

The invention claimed is:

1. Anchoring member provided for being mounted on an upper surface of a support pedestal, the support pedestal being provided for supporting a corner of a tile, which anchoring member comprises a plate having a plate surface with an essentially parallelogram shaped geometry, the plate having a first raising edge and a first horizontal edge, the plate further having a second raising edge and a second horizontal edge, the first and second horizontal edges extending parallel to each other, the first and second raising edges extending parallel to each other, the plate being provided with a notch extending in the plate surface as from a part of a border of said plate, said notch extending from a first corner located on a crossing of the first raising edge and the first horizontal edge of the parallelogram shaped geometry over essentially a quarter of the plate surface, which plate is provided for being rotatably partially entered in a cut-out situated in a lateral sidewall of the corner of the tile when the corner of the tile is supported by the support pedestal.

2. Anchoring member as claimed in claim 1, wherein a second horizontal edge of the parallelogram shaped geometry is provided with a cavity.

3. Anchoring member as claimed in claim 2, wherein the cavity comprises an entering edge having a right angle and another entering edge having an angle inclined over approximately 20°.

4. Anchoring member as claimed in claim 2, wherein the cavity extends over a depth of about 3 mm.

5. Anchoring member as claimed in claim 1, wherein the parallelogram shaped geometry comprises a second and a third corner respectively situated at the other end of the first raising edge and the first horizontal edge of the one where the first corner is situated, said second and third corner being cut-off.

6. Anchoring member as claimed in claim 1, wherein at a fourth corner of the parallelogram shaped geometry situated diagonally opposite to the first corner, a hole crossing the plate is provided.

7. Anchoring member as claimed in claim 1, wherein a lower surface of the plate is provided with water draining grooves.

8. Anchoring member as claimed in claim 1, wherein a stem extends from a lower surface of the plate, which stem is provided with a threaded section.

9. Anchoring member as claimed in claim 8, wherein the threaded section protrudes from the stem.

10. Anchoring member as claimed in claim 8, wherein an upper surface of the plate is provided with a further cavity provided for receiving a screwdriver head, said further cavity being located in an extension of the stem.

* * * * *